US009589461B1

(12) United States Patent
Byrne et al.

(10) Patent No.: US 9,589,461 B1
(45) Date of Patent: Mar. 7, 2017

(54) BATTERY POWERED WALL MOUNTED REMOTE CONTROL FOR CEILING FANS AND LIGHTS

(71) Applicant: Palm Coast Imports, LLC, Germantown, TN (US)

(72) Inventors: Brendan P. Byrne, Germantown, TN (US); James P. Burns, Memphis, TN (US)

(73) Assignee: HKC-US, LLC, Memphis, TN (US)

( * ) Notice: Subject to any disclaimer, the term of this patent is extended or adjusted under 35 U.S.C. 154(b) by 35 days.

(21) Appl. No.: 14/665,580

(22) Filed: Mar. 23, 2015

Related U.S. Application Data

(60) Provisional application No. 61/972,268, filed on Mar. 29, 2014.

(51) Int. Cl.
*G08C 19/00* (2006.01)

(52) U.S. Cl.
CPC ..... *G08C 19/00* (2013.01)

(58) Field of Classification Search
CPC ..... G08C 19/00
USPC ..... 340/12.55
See application file for complete search history.

(56) References Cited

U.S. PATENT DOCUMENTS

| | | | | |
|---|---|---|---|---|
| 2,659,169 A | | 11/1953 | Brennan | |
| 2,742,250 A | | 4/1956 | Cronberger | |
| 2,967,038 A | | 1/1961 | Lennemann | |
| 3,031,799 A | | 5/1962 | Bradsby | |
| 3,713,614 A | | 1/1973 | Taylor | |
| 4,678,150 A | | 7/1987 | Newman | |
| 4,745,397 A | | 5/1988 | Lagerbauer | |
| 4,875,654 A | | 10/1989 | Chandonnet | |
| 5,041,825 A | * | 8/1991 | Hart | G08C 17/02 318/16 |
| 5,055,977 A | | 10/1991 | Acquanetta | |
| 5,239,205 A | * | 8/1993 | Hoffman | H01H 23/00 200/277.2 |

(Continued)

FOREIGN PATENT DOCUMENTS

| | | |
|---|---|---|
| EP | 2387918 | 10/2011 |
| JP | 8102986 | 4/1996 |

OTHER PUBLICATIONS

Wayfair, Savoy House Hanson Held Fan Remote Control—RMT002, http://www.wayfair.com/Savoy-House-Programmable-Thermostatic-Hand-Held-Fan-Remote-Control-RMT002-SOY4281.html, Sep. 2011, 7 pages.

*Primary Examiner* — Edwin Holloway, III
(74) *Attorney, Agent, or Firm* — Brian S. Steinberger; Law Offices of Brian S. Steinberger, P.A.

(57) ABSTRACT

Systems, devices and methods for providing a battery powered wall mounted remote control for ceiling fans and lights. The battery powered remote control can be installable over an existing wall switch without hard wiring into electrical system at the switch box. The remote control housing is decorative in nature and has functional fan and light buttons for remotely controlling operation of the fan and light fixture. The remote housing attaches to the hard wired wall mounted switch using existing hardware that previously held the switch plate in place. The remote housing has a door that opens to allow the original fan/light switch to still be used in an on/off power control for the device being controlled by the battery powered wall mounted remote control for ceiling fans and lights.

10 Claims, 9 Drawing Sheets

(56) References Cited

U.S. PATENT DOCUMENTS

| | | | | |
|---|---|---|---|---|
| 5,458,311 | A * | 10/1995 | Holbrook | H05B 39/088 248/205.1 |
| 5,528,229 | A * | 6/1996 | Mehta | F04D 25/088 165/247 |
| 5,977,901 | A | 11/1999 | Fenner | |
| 6,120,262 | A * | 9/2000 | McDonough | H05B 37/0272 318/16 |
| 6,305,656 | B1 | 10/2001 | Wemyss | |
| 8,234,509 | B2 | 7/2012 | Gioscia | |
| 8,330,638 | B2 | 12/2012 | Altonen | |
| 8,695,934 | B2 | 4/2014 | Jensen | |
| 2010/0225499 | A1 | 9/2010 | Peh | |
| 2010/0271802 | A1* | 10/2010 | Recker | H05B 33/0803 362/20 |
| 2011/0267802 | A1 | 11/2011 | Petrillo | |
| 2012/0104197 | A1* | 5/2012 | Jensen | F16M 13/02 248/205.1 |
| 2015/0077021 | A1* | 3/2015 | Smith | F21V 23/0435 315/362 |
| 2015/0189725 | A1* | 7/2015 | Karc | H05B 37/0272 315/291 |
| 2015/0364274 | A1* | 12/2015 | Khattak | H01H 9/0235 200/51 R |

* cited by examiner

BATTERY POWERED WALL MOUNTED REMOTE CONTROL FOR CEILING FANS AND LIGHTS

CROSS REFERENCE TO RELATED APPLICATIONS

This application claims the benefit of priority to U.S. Provisional Application No. 61/972,268 filed on Mar. 29, 2014, the entire disclosure of which is incorporated by reference in its' entirety.

FIELD OF INVENTION

This invention relates to ceiling fans, and in particular to systems, devices, and methods for a battery powered remote control for ceiling fans and lights to be installed over a wall switch without hard wiring into the electrical system at the switch box.

BACKGROUND AND PRIOR ART

Wall mounted hard wired remote controls for ceiling fans and lights require the consumer to remove the original hard wired switch and install a new hard wired switch with remote control functions built in. This can be very intimidating and potentially hazardous for novice do-it-yourselfers.

Current battery powered wall mounted remote controls for ceiling fans and lights require the permanent mounting of the device into the wall near the hard wired switch. This action can cause damage to the wall that is costly to repair and is an eyesore because it stands off from the wall in a manner that is not normal.

U.S. Pat. No. 8,695,934, assigned to Palm Coast Imports LLC, the assignee of the present application, describes a detachable magnetic docking system for a handheld remote control device that includes a docking plate with a major surface and a shell for the handheld device with a reverse surface. The docking plate is wall mounted. The major surface and the reverse surface are contoured to mate when adjacent one another to align the shell over the docking plate. Cooperative magnetic elements are located in the docking plate and in the shell to retain the handheld device on the docking plate. The contour of the major surface includes a recessed area. The handheld device includes an internal battery compartments located adjacent non-recessed areas of the major surface.

What is needed to solve the problem is a battery powered remote control for ceiling fans and lights that can be installed over the current switch without hard wiring into the electrical system at the switch box.

SUMMARY OF THE INVENTION

A primary objective of the present invention is to provide systems, devices, and methods for a battery powered remote control for ceiling fans and lights to be installed over a wall switch without hard wiring into the electrical system at the switch box A secondary objective of the present invention is to provide systems, devices, and methods for a battery powered remote control for ceiling fans and lights with a remote housing that is decorative in nature and has functional buttons for fan speed and light controls.

A third objective of the present invention is to provide systems, devices, and methods for a battery powered remote control for ceiling fans and lights with a housing that attaches to the hard wired wall mounted switch using existing hardware used to hold the switch plate in place.

A fourth objective of the present invention is to provide systems, devices, and methods for a battery powered remote control for ceiling fans and lights with a remote housing that has a door that opens to allow the original fan/light switch to still be used in an on/off power control for the device being controlled by the battery powered wall mounted remote control.

The design and function of the battery powered remote control for ceiling fans and lights of the present invention has not been suggested, anticipated or rendered obvious by any of the prior art references.

A battery operated remote control embodiment can include a remote control housing attachable to an existing wall switch after a wall switch cover has been removed, the remote control housing including a door hingedly attached to cover a portion of the housing and a control panel adjacent to the door, an electronic assembly connected with the control panel with plural switches for controlling an operation of a fan and a light fixture attached to the fan and a transmitter for transmitting a control signal to a received connected the fan electronics, and a battery compartment accessible when the door is in an open position for a battery to power the electronic assembly, wherein when the door is in the open position the wall switch is accessible for applying and removing electrical power from the fan.

The remote control housing can include a front housing and a rear housing, the electronic assembly sandwiched between the front housing and the rear housing.

The remote control can further include a switch adapter plate with an aperture to mount the switch adapter plate over the wall switch and with mounting holes aligned to the switch adapter plate to the wall switch, the remote control housing attachable over the switch adapter plate.

The plural buttons can include a fan operation button for turning a fan on and off, a fan speed button for selecting a speed of the fan, and a light control button for turning a light fixture attached to the fan on and off.

The fan speed button can include a low speed button, a medium speed button and a high speed button.

The remote control can further include a delay button for injecting a time delay prior to turning the light fixture off.

The electronic assembly can include an electronic circuit for randomly turning the light fixture attached to the fan on and off after the delay button and the light button are simultaneously depressed.

The electronic assembly can include a sync button depressable for syncing the remote control transmitter with the fan receiver.

The electronic assembly can further include a low battery indicator.

The electronic assembly can further include a memory for storing a selected fan speed, wherein when the fan is turned back on the fan speed is the previously selected fan speed.

A remotely controllable fan system can include a fan assembly with a transmitter connected to the fan assembly, a wall switch for applying and removing electrical power to the fan assembly, a remote control assembly attached over the wall switch as a wall switch remote control cover.

The remote control assembly can include a housing. a control panel and electronic assembly with plural buttons for controlling an operation of the fan, a transmitter for transmitting a corresponding control signal to the fan receiver, and a battery for supplying a voltage source to the remote control electronic assembly.

The remote control assembly can include a front housing, and a rear housing, the electronic assembly sandwiched between the front housing and the rear housing.

The remotely controllable fan system can further include a switch adapter plate with an aperture to mount the switch adapter plate over the wall switch and with mounting holes aligned to the switch adapter plate to the wall switch, the remote control housing attachable over the switch adapter plate.

The plural buttons can include a fan operation button for turning a fan on and off, a fan speed button for selecting a speed of the fan, and a light control button for turning a light fixture attached to the fan on and off.

The fan speed button can includes a low speed button, a medium speed button and a high speed button.

The remotely controllable fan system can further include a delay button for injecting a time delay prior to turning the light fixture off.

The electronic assembly can include an electronic circuit for randomly turning the light fixture attached to the fan on and off after the delay button and the light button are simultaneously depressed.

The electronic assembly can include a sync button depressable for syncing the remote control transmitter with the fan receiver.

The electronic assembly can further include a low battery indicator.

The electronic assembly can further include a memory for storing a selected fan speed, wherein when the fan is turned back on the fan speed is the previously selected fan speed.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figure 1:
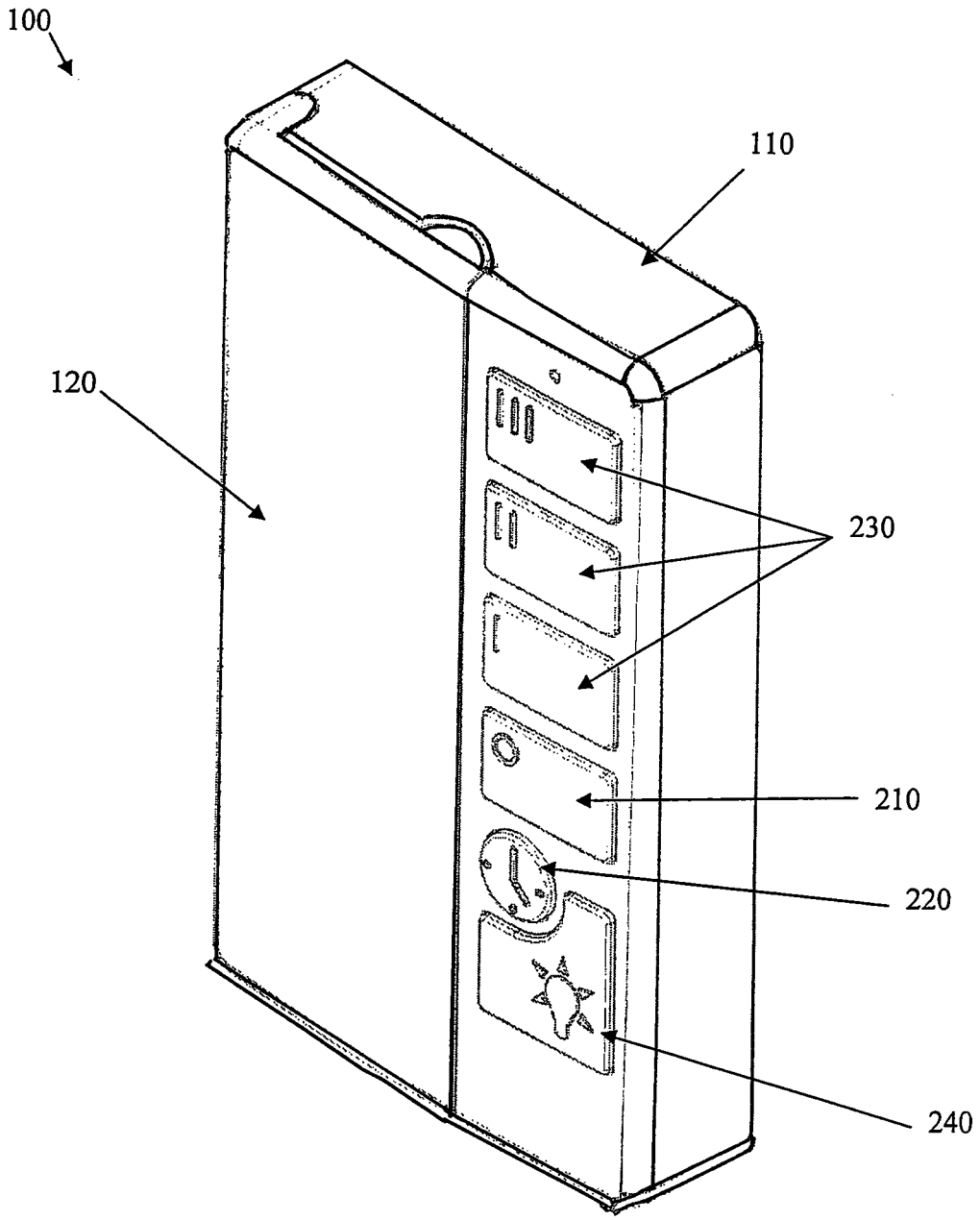
FIG. 1 is a perspective front view of the wall mounted remote control with the switch door in the closed position.

100 wall mounted battery operated remote control
110 remote control front housing
115 back housing
120 door
130 battery compartment
133 battery
140 switch adapter plate
142 toggle switch
144 décor rocker switch
150 mounting aperture
200 fan and light control switch panel
210 fan control button
220 fan delay button
230 fan speed control button
240 light control button
300 electrical assembly
310 printed circuit board
320 sync button
330 low battery indicator The battery powered remote control for ceiling fans and lights of the present invention solves the problem of how to install a wall mount remote without rewiring the switch box. FIG. 1 is a perspective view of the battery powered remote control for ceiling fans and lights 100 according to the present invention. The battery powered remote control 100 encloses the electrical circuitry 300 in a wall mountable housing 110 that replaces the existing wall switch cover plate. The switch adapter plate 140 and housing 110 installs over the existing hard wired wall switch 140 that controls the fan to be controlled by the remote control 100. The remote control electrical assembly sends a signal to a receiver that is installed in the ceiling fan (not shown) to be controlled. The two electrical components communicate wirelessly. The receiver connected with the fan assembly converts the wireless signal into a command to alter the function to the fan and light that is being controlled.

As shown in FIG. 1, the remote control housing is decorative in nature and has functional buttons for fan speed and light controls. As shown, the remote control housing is decorative in nature and has functional buttons for fan speed and light controls. The wall mounted battery operated remote control 100 includes the housing 110, a door 120 covering the wall switch, and a fan and light control switch panel 200. The controls shown include a light control button 240, a fan control button 210, and fan speed buttons 230. In the example shown, the fan speed includes three buttons, one for each speed, slow, medium and fast. Alternatively one button could be used to toggle between the three different speeds.

Figure 2:
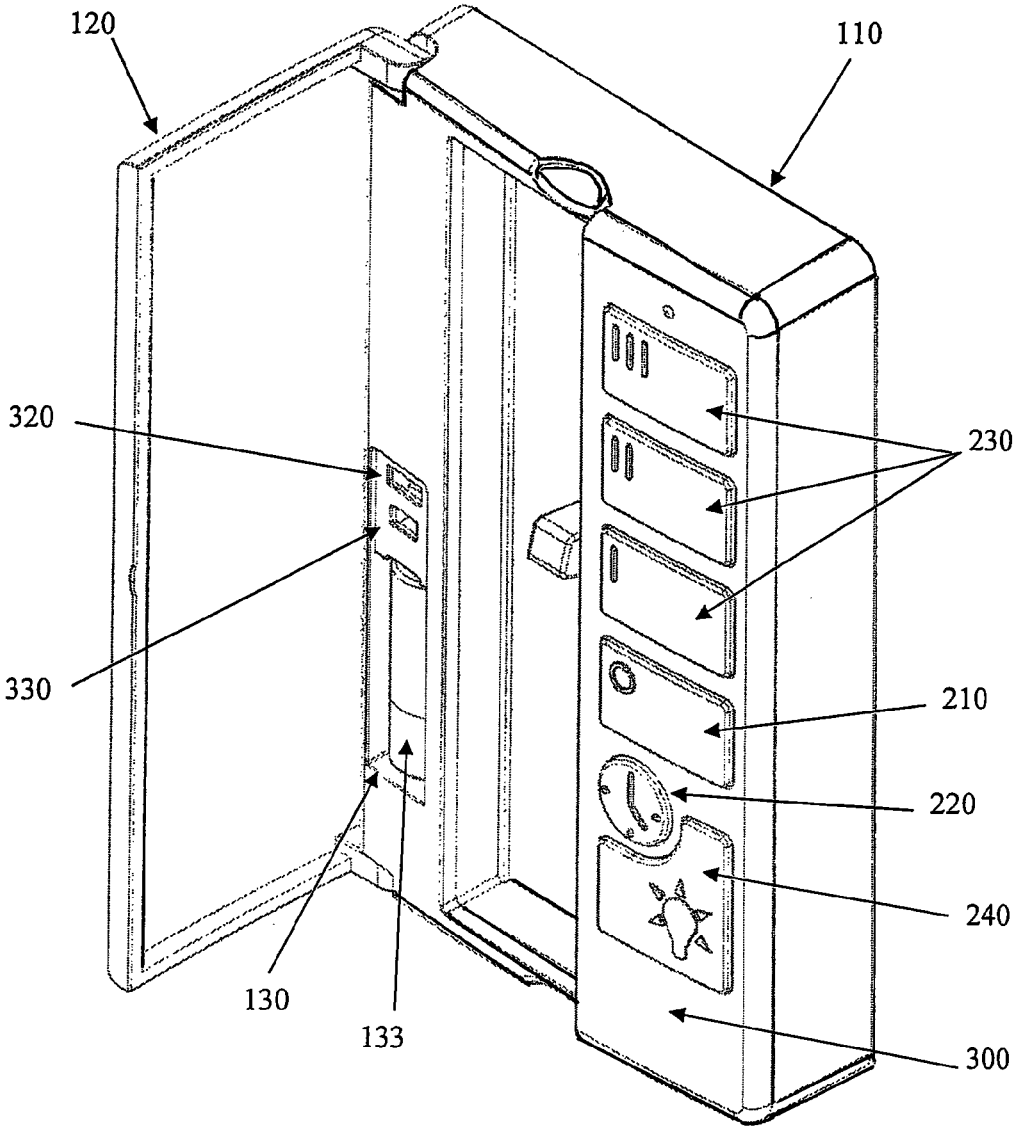
FIG. 2 is a perspective front view of the wall mounted remote control with the switch door in the open position.

FIG. 2 is a perspective view of the wall mounted remote control 100 with the door 120 open exposing the wall switch, a toggle wall switch, and the battery compartment 130. When properly installed over the switch plate, the remote control housing extends a distance from the wall surface. In a preferred embodiment, the profile of the housing is approximately 0.74 inches. Mounting the remote control assembly of the present invention over an existing wall switch provides additional fan and light functions in the safe location over the hard wired wall switch.

The battery powered wall mounted remote control for ceiling fans and lights of the present invention differs from what currently exists. Prior art battery powered wall mounted remote controls for ceiling fans and lights require holes to be drilled into the wall to mount the remote controller or to mount a remote control docking station as described in U.S. Pat. No. 8,695,934, assigned to the same assignee of the present application and incorporated herein by reference.

Other prior art remote controls are hard wired remote control systems for ceiling fans and lights. Because they are hard wired, they may not wired correctly because many consumers do not have the skills necessary to perform the complex wiring required to install the remote control system. This results in a failed installation and potentially an electrical hazard. Alternatively, consumers are required to pay a licensed electrician to complete the installation, making remote control less attractive.

The wall mounted battery powered remote control of the present invention does not require holes to be drilled in the wall or for the house hard wired switch to plate be modified. Instead, the existing switch plate is replaced by battery powered wall mounted remote control for fans and lights. The wall mounted remote control can replaces the existing switch plate fasteners from the wall switch plate with new fasteners to attach remote control housing to the wall switch.

Figure 3A:
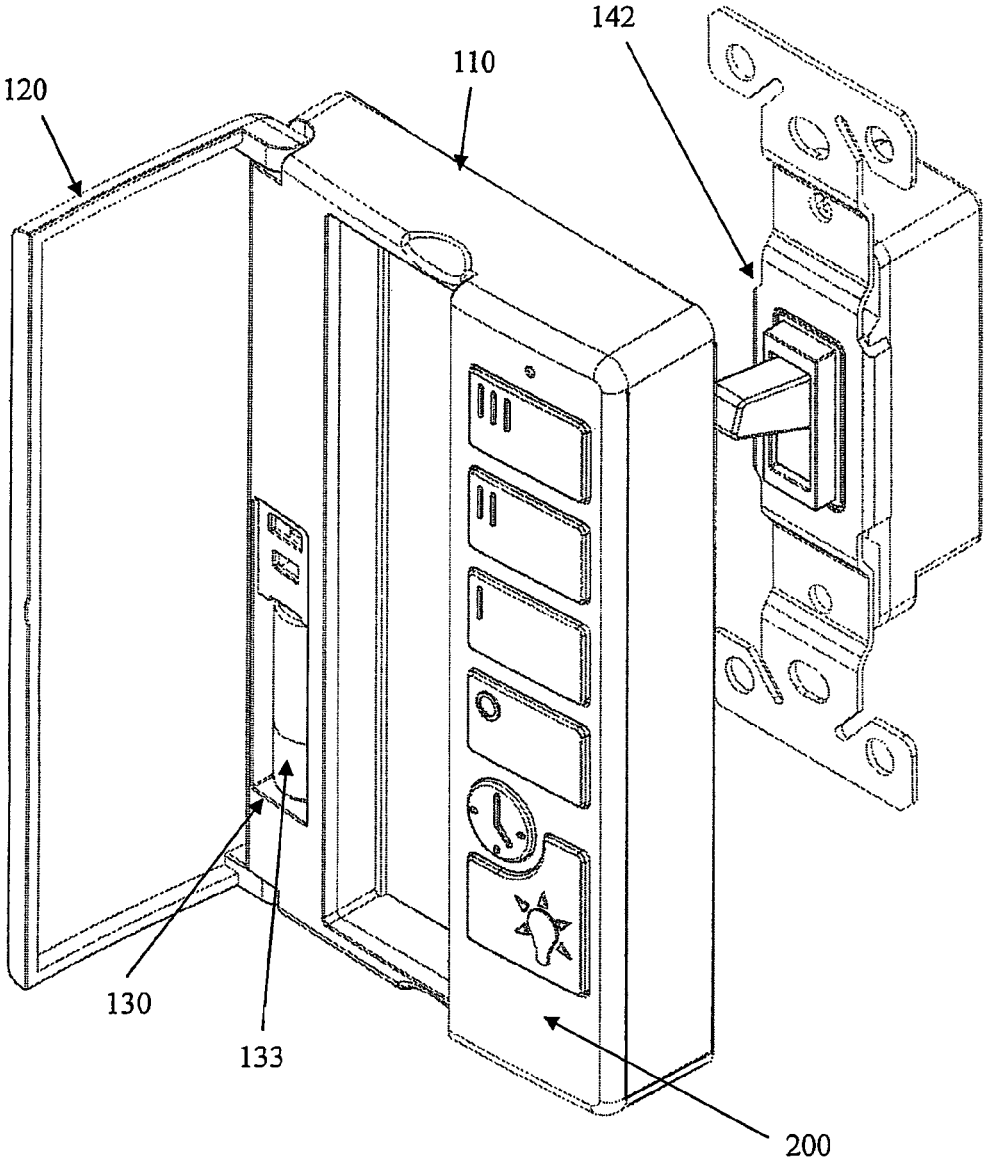
FIG. 3*a* is an exploded view of the switch adapter, wall mounted remote and existing hard wired toggle switch.
Figure 3B:
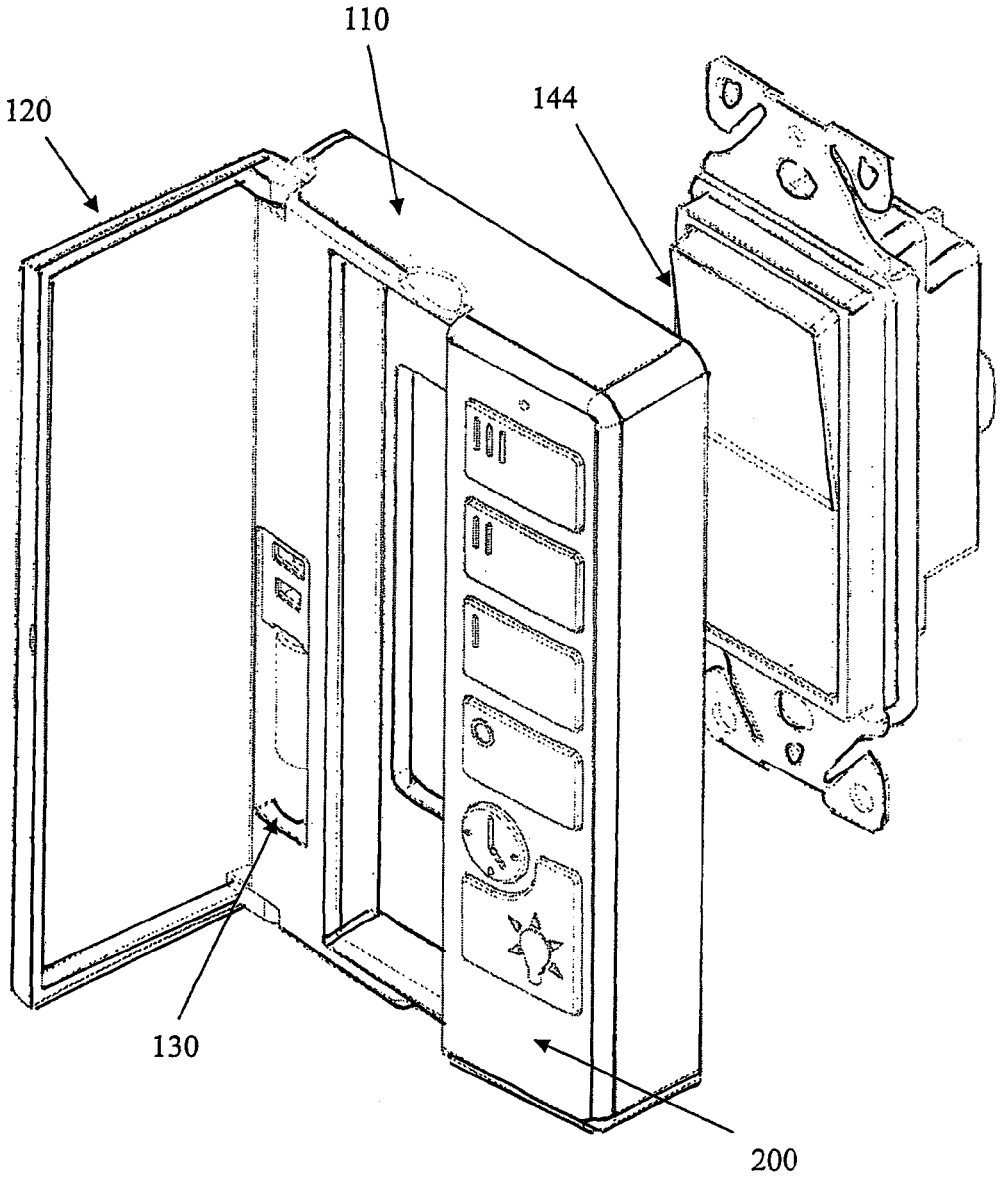
FIG. 3*b* is an exploded view of the switch adapter, wall mounted remote and existing hard wired décor rocker switch.

Referring to FIGS. 3*a* and 3*b*, the wall mounted battery powered remote control assembly 100 has a door 120 that opens allowing the original hard wired wall switch to used to control electrical power to the fan and light such that when the existing fan power switch is turned off, the fan assembly is not receiving electrical power, the remote control assembly is ineffective. The wall mounted remote control housing 110 can be configured to be installed over a décor rocker type wall switch as shown in FIG. 3*b* or over a toggle wall switch as shown in FIG. 3*a*.

Another problem associated with prior art battery powered wireless remote control devices for ceiling fans and lights is that they do not have a "normal" place in the home for installation because they are required to be affixed to the wall in a manner that is not normal for electrical appliances. This type of permanent mounting can damage the wall materials and take away from the décor of the room.

Figure 4A:
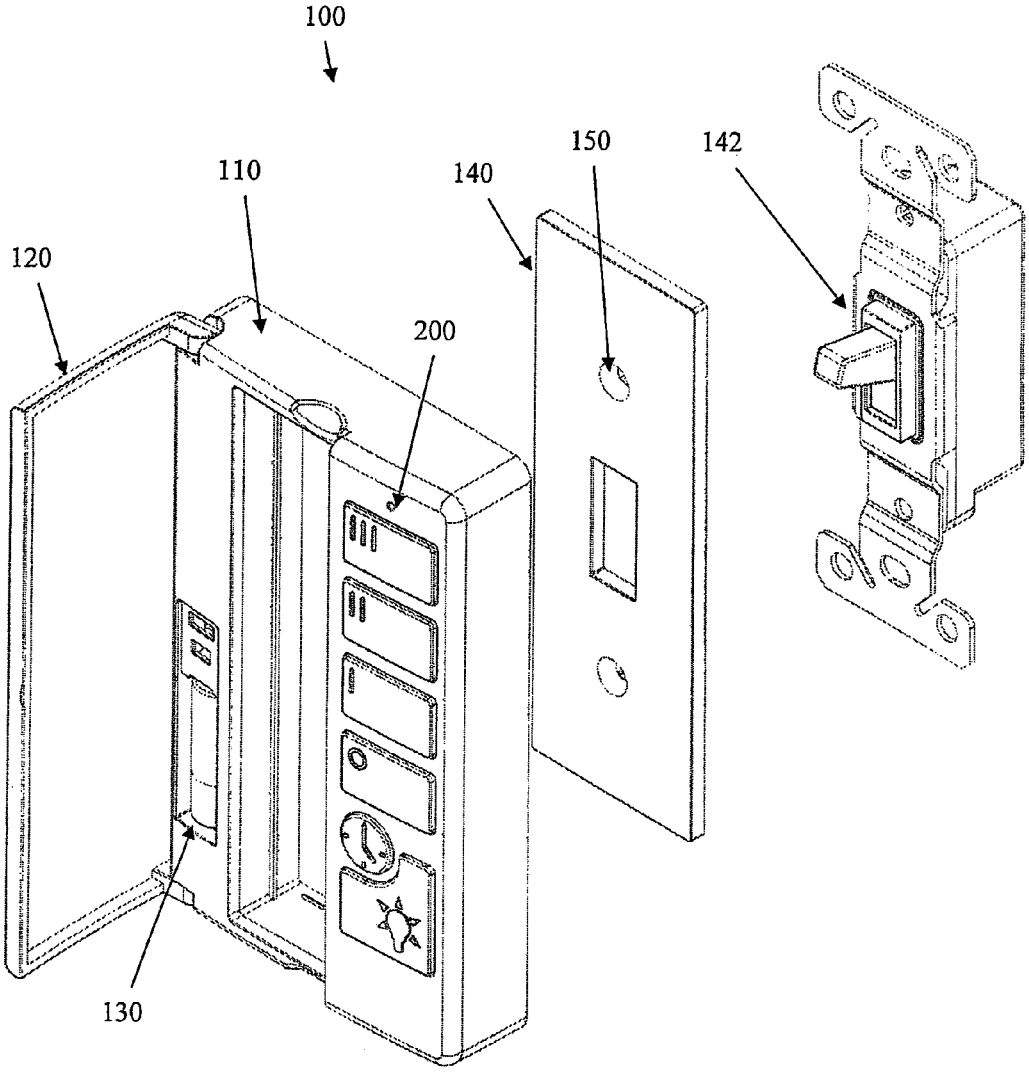
FIG. 4*a* is an exploded view of the switch adapter plate, wall mounted remote and existing hard wired toggle switch.
Figure 4B:
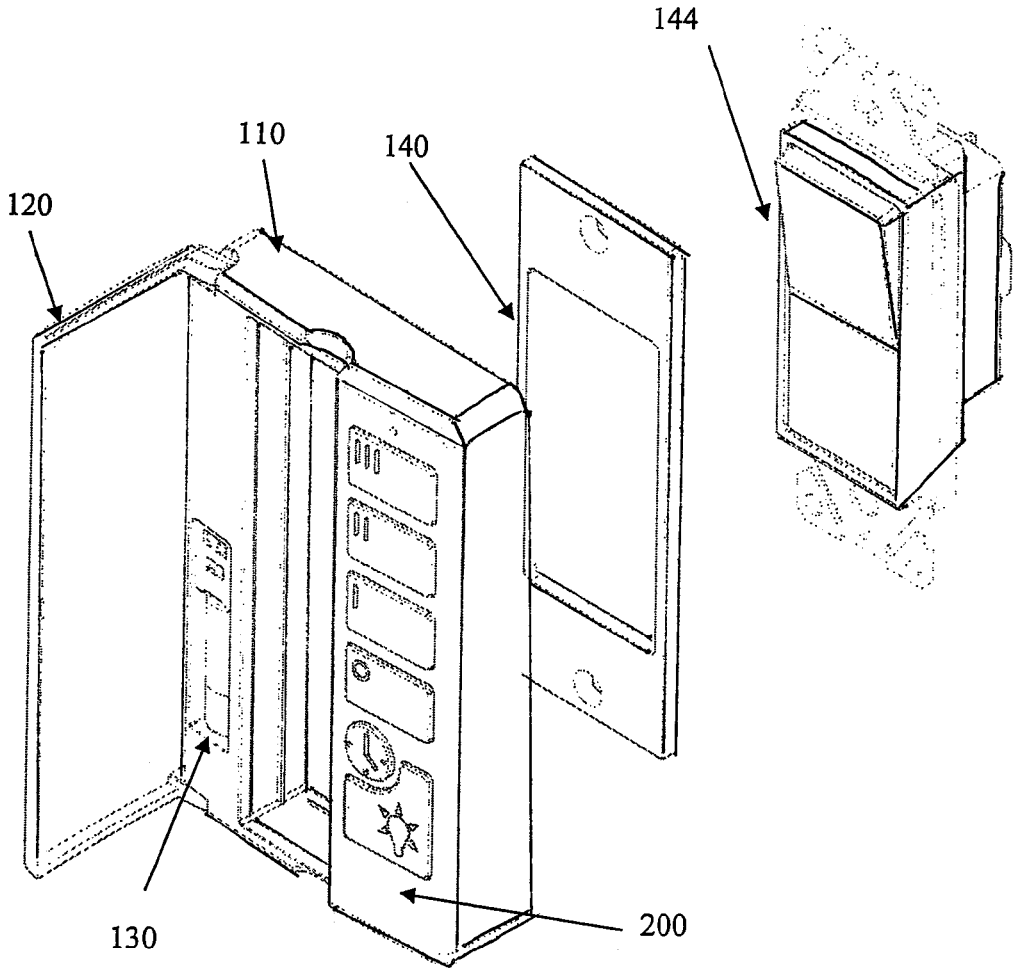
FIG. 4*b* is an exploded view of the switch adapter plate, wall mounted remote and existing hard wired décor rocker switch.

The battery powered remote control for ceiling fans and lights 100 is intended to be installed over the current wall switch without hard wiring into the electrical switch box that the existing fan switch is hard wired into. FIGS. 4*a* and 4*b* are exploded views showing the battery operated remote housing 110, the switch adapter plate 140, and the wall switch to show how the new battery operated remote control is attached over an existing wall switch. As shown, battery operated remote control can be configured for a toggle type wall switch 142 as shown in FIG. 4*a* or a décor rocker switch as shown in FIG. 4*b*. Both switch adapter plates 140 include mounting holes 150 for attaching the switch adapter to the existing hard wired wall switch.

Installing the battery powered remote control for fans and lights 100 of the present invention is accomplished with two wall switch cover mounting screws. First, the upper and lower screws are removed from the existing switch plate. The switch adapter plate 140 is placed over the existing wall switch cover screw holes and the adapter plate 140 is secured in place using two mounting screws. After the switch adapter plate has been attached, the battery powered remote control housing 110 is pressed in place over the switch adapter plate 140. Now the battery is ready to be installed and the remote control electronics are sync with ceiling fan receiver.

Figure 5:
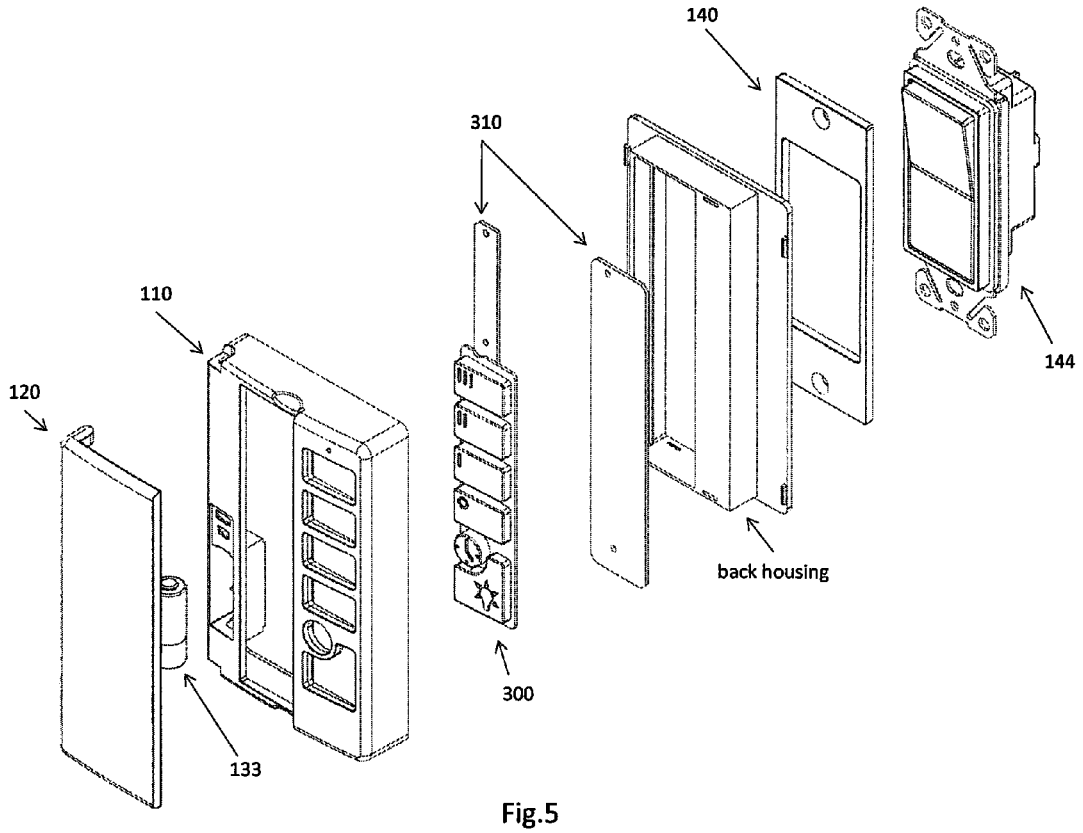
FIG. 5 is an exploded view of the wall mounted remote control.

FIG. 5 is an exploded view of a wall mounted battery operated fan and light remote control. As shown, the remote control housing includes a front housing 110 and a rear housing 115 with an electronic assembly sandwiched between the front housing 110 and the rear housing 115. In the example shown, the electronic assembly includes a circuit board for mounting the remote control switch keys electrically connected with a second printed circuit board that contains the control circuitry and the transmitter, powered by the battery.

Figure 6A:
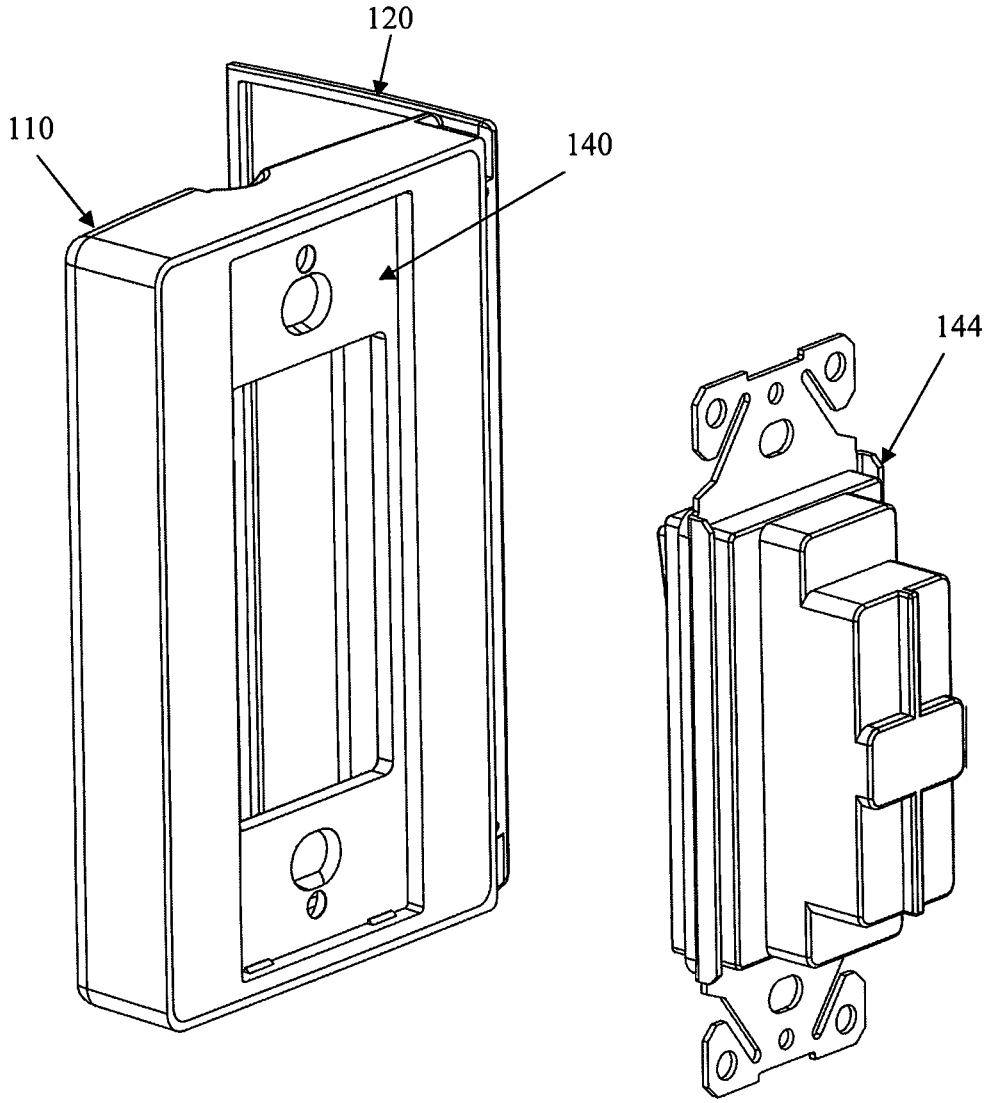
FIG. 6*a* shows a rear view of a housing configured to be mounted directly to the existing wall switch after the existing switch plate s removed.
Figure 6B:
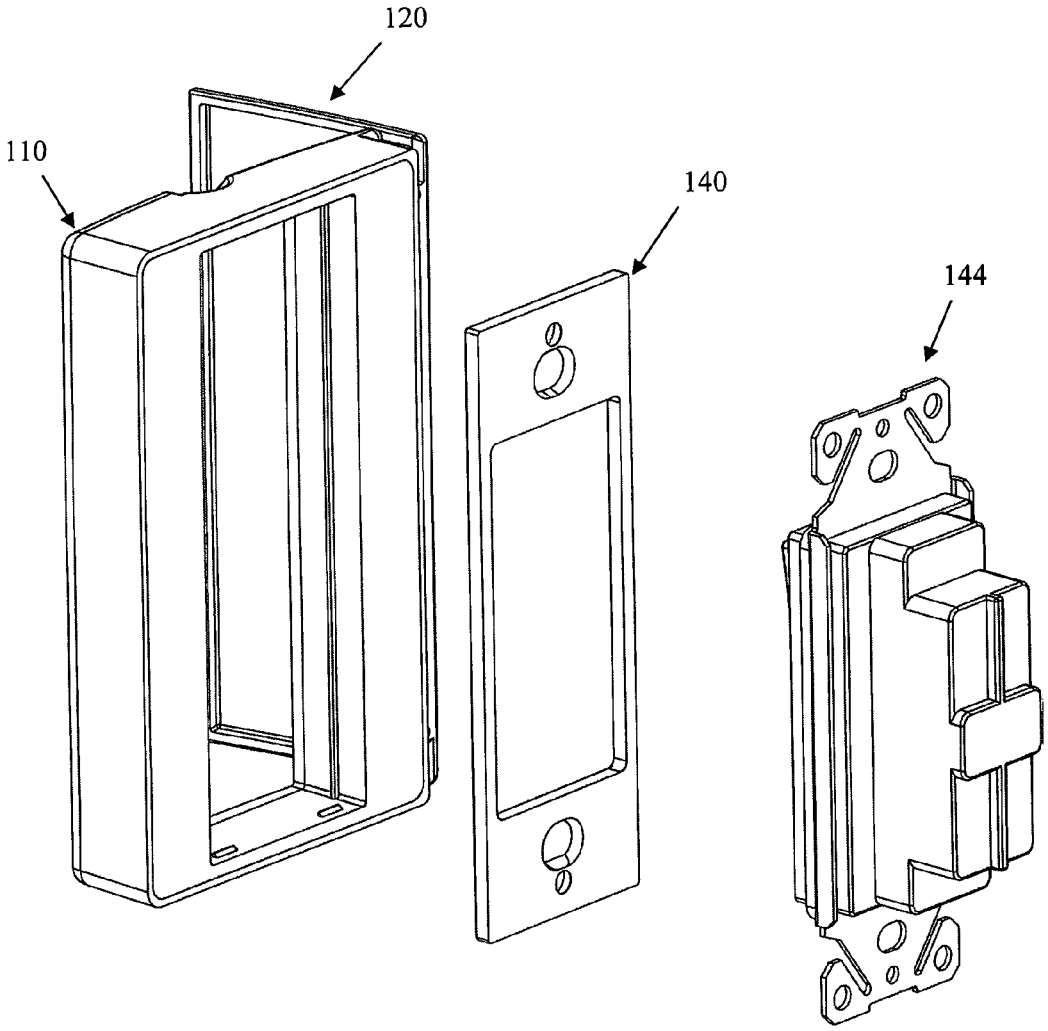
FIG. 6*b* is a rear view showing the intermediary switch adapter plate attached over the existing wall switch and the housing that is press fitted over the adapter plate.

For the user, the housing is a single unit that can be snap mounted over the switch adapter plate. Alternative, the housing can be adapted for the rear housing to be attached directly to the wall switch. FIG. 6*a* shows a rear view of a housing configured to be mounted directly to the existing wall switch after the existing switch plate s removed. FIG. 6*b* is a rear view showing the intermediary switch adapter plate that is attached over the existing wall switch and the housing 110 that is press fitted over the adapter plate 140.

Installation of the wall mounted battery operated remote control includes the steps of locating the wall switch that is currently used to control the ceiling fan it is to be controlled remotely and selecting the remote control housing that corresponds to the type of wall switch used, toggle or rocker. After removing electrical power to the wall switch at the breaker box, remove the two screws from the existing switch plate and remove the switch plate cover. Then the switch adapter plate is snapped onto the rear housing and the two switch cover holes 150 are aligned with the wall switch cover plate mounting holes and the mounting screws are reinstalled.

The electrical power is turned back on at the breaker box, the battery is installed in the remote control battery compartment. The electrical assembly is configured to sync with the remote control receiver connected to the fan. The remote control should be operational once power is established. If the remote control does not work, the power is turned off for approximately 15 seconds and then turned back on. Referring back to FIG. 2, the "sync" button is depressed using a pencil or pen tip for several seconds. Once the system as synced, the fan turns on at a high speed to confirm that the transmitter and receiver are successfully synced.

As previously described, the wall mounted batter operated remote control is designed to work with an existing wall switch such that the fan and light can be turned on and off using the wall switch. When the wall switch is turned back on, the fan and light operation resumes the last commands transmitted before being switched off. Still referring to FIG.

2, the battery operated wall remote control has a low battery' warning. The LED 330 on the front panel slowly blinks when the battery is low, or has less than 5% power remaining.

The battery operated wall mounted remote control has 3 fan speeds and an off button, the selected button is tapped once for the desired speed. The light button turns the fan light on or off with one tap. If dimmable light bulb is installed in the fan, the light button is depressed and held to dim the lights. Other features include 'walk away light delay' that allows the user to tap the clock icon 220 and the light blinks, indicating the feature has been activated. The ceiling fan light will turn off after a 60 second delay. Another feature is 'Safe Home' to allow the user to press and hold the light and clock buttons simultaneously for 5 seconds, after which the light will blink 3 times to indicate the feature has been activated. Once activated, the light turns on randomly to simulate occupancy while the homeowners are away from home. An instruction guide can be attached inside the battery door.

Although the controls refer to buttons, other types of switches can be used, such as but not limited to toggle switches, slide switches, other operator activated switches, touch screen switches, and the like.

While the wall mountable battery operated remote control for a fan and light is described and shown as a single wall unit, the housing can include a docking station adjacent to the door for a removable handheld remote control until. Those skilled in the art will understand that alternative configurations can be used without deviating from the scope of the wall mounted batter operated remote control described herein.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A battery operated remote control comprising:

a remote control housing attachable to an existing wall switch after a wall switch cover has been removed, the remote control housing comprising a front housing and a rear housing and a slot opening passing from the front housing through the rear housing, the front housing including a door hingedly attached to cover a portion of the front housing and a control panel adjacent to the door;

an electronic assembly connected with the control panel with plural switches for controlling an operation of a fan and a light fixture attached to the fan and a transmitter for transmitting a control signal to the fan; and a battery compartment accessible when the door is in an open position for a battery to power the electronic assembly, wherein when the door is in the open position the wall switch is accessible and exposed through the slot opening passing from the front housing to the rear housing, and the wall switch is not accessible when the door is in a closed position closing off the portion of the front housing.

2. The remote control of claim 1, further comprising:

a switch adapter plate having side edges with an aperture passing through a front and rear of the adapter plate, so as to mount the switch adapter plate over the wall switch and the switch adapter plate having mounting holes aligned to attach the switch adapter plate to the wall switch, the rear housing having a rearwardly facing indentation with inner side walls that is attachable by being pressed over and snapped about the side edges of the switch adapter plate.

3. The remote control of claim 1 wherein the plural buttons include a fan operation button for turning a fan on and off, a fan speed button for selecting a speed of the fan, and a light control button for turning a light fixture attached to the fan on and off.

4. The remote control of claim 3, wherein the fan speed button includes a low speed button, a medium speed button and a high speed button.

5. The remote control of claim 3 further comprising:

a delay button for injecting a time delay prior to turning the light fixture off.

6. The remote control of claim 5, wherein the electronic assembly includes an electronic circuit for randomly turning the light fixture attached to the fan on and off after the delay button and the light button are simultaneously depressed.

7. The remote control of claim 1, wherein the electronic assembly includes a sync button depressable for syncing the remote control transmitter with the fan receiver.

8. The remote control of claim 1, wherein the electronic assembly further includes a low battery indicator.

9. The remote control of claim 1, wherein the electronic assembly further includes a memory for storing a selected fan speed, wherein when the fan is turned back on the fan speed is the previously selected fan speed.

10. The remote control of claim 1, wherein the rear housing includes mounting holes, and the rear housing has a rearwardly facing indentation with inner side walls, wherein the mounting holes are aligned to attach the remote control housing to the wall switch, and the rearwardly facing indentation with inner side walls fits about the side portions of the wall switch.

* * * * *